US007568259B2

(12) United States Patent
Yan

(10) Patent No.: US 7,568,259 B2
(45) Date of Patent: Aug. 4, 2009

(54) ROBOTIC FLOOR CLEANER

(76) Inventor: Jason Yan, 3F-4, No. 1, Alley 3, Lane 74, Wenzhou Street, Taipei (TW)

( * ) Notice: Subject to any disclaimer, the term of this patent is extended or adjusted under 35 U.S.C. 154(b) by 584 days.

(21) Appl. No.: 11/164,973

(22) Filed: Dec. 13, 2005

(65) Prior Publication Data

US 2007/0130717 A1 Jun. 14, 2007

(51) Int. Cl.
*A47L 5/00* (2006.01)

(52) U.S. Cl. ..... 15/319; 15/339; 15/347; 15/340.1; 15/352

(58) Field of Classification Search ..... 15/319, 15/352, 347, 339, 340.1
See application file for complete search history.

(56) References Cited

U.S. PATENT DOCUMENTS

2004/0025268 A1* 2/2004 Porat et al. ..... 15/1.7
2004/0236468 A1* 11/2004 Taylor et al. ..... 700/245
2005/0015920 A1* 1/2005 Kim et al. ..... 15/352
2005/0022331 A1* 2/2005 Kim et al. ..... 15/319

* cited by examiner

*Primary Examiner*—Joseph J Hail, III
*Assistant Examiner*—Robert Scruggs
(74) *Attorney, Agent, or Firm*—Bacon & Thomas, PLLC

(57) ABSTRACT

A robotic floor cleaner includes a main body, which houses a propelling unit for moving the robotic floor cleaner on the floor and a control unit for controlling the operation of the propelling unit to move the robotic floor cleaner on the floor according to a predetermined steering mode, a daughter body detachably fastened to the main body and houses a vacuum cleaner unit for removing dust, and a handle assembly detachably connectable to the daughter body.

1 Claim, 4 Drawing Sheets

ROBOTIC FLOOR CLEANER

BACKGROUND OF THE INVENTION

1. Field of the Invention

The present invention relates to floor cleaning apparatus and more particularly to a robotic floor cleaner, which can be alternatively set between a first status for automatic cleaning operation and a second status for manual cleaning operation.

2. Description of the Related Art

Following fast development of technology, various automatic home appliances have been disclosed and have appeared on the market. Taiwan patent publication number 92123812 discloses a robotic floor cleaner for cleaning the floor automatically. However, this design of robotic floor cleaner moves on the floor according to the designed steering mode, and is not operable manually for cleaning desired specific locations.

SUMMARY OF THE INVENTION

The present invention has been accomplished under the circumstances in view. It is an object of the present invention to provide a robotic floor cleaner, which can be alternatively set between a first status for automatic cleaning operation and a second status for manual cleaning operation.

To achieve this and other objects of the present invention, the robotic floor cleaner comprises a main body, a daughter body, and a handle assembly. The main body comprises a propelling unit for moving the robotic floor cleaner on the floor, and a control unit for controlling the operation of the propelling unit to move the robotic floor cleaner on the floor according to a predetermined steering mode. The daughter body is detachably fastened to the main body, comprising a wind tunnel extending to the bottom side, a dust collector, and a fan adapted to cause a vacuum in the wind tunnel to suck dust from the floor to the dust collector. The handle assembly is detachably connectable to the daughter body. When the daughter body is detached from the main unit, the handle assembly can be fastened to the daughter body and used with the daughter body as a manual vacuum cleaner.

DETAILED DESCRIPTION OF THE INVENTION

Figure 1:
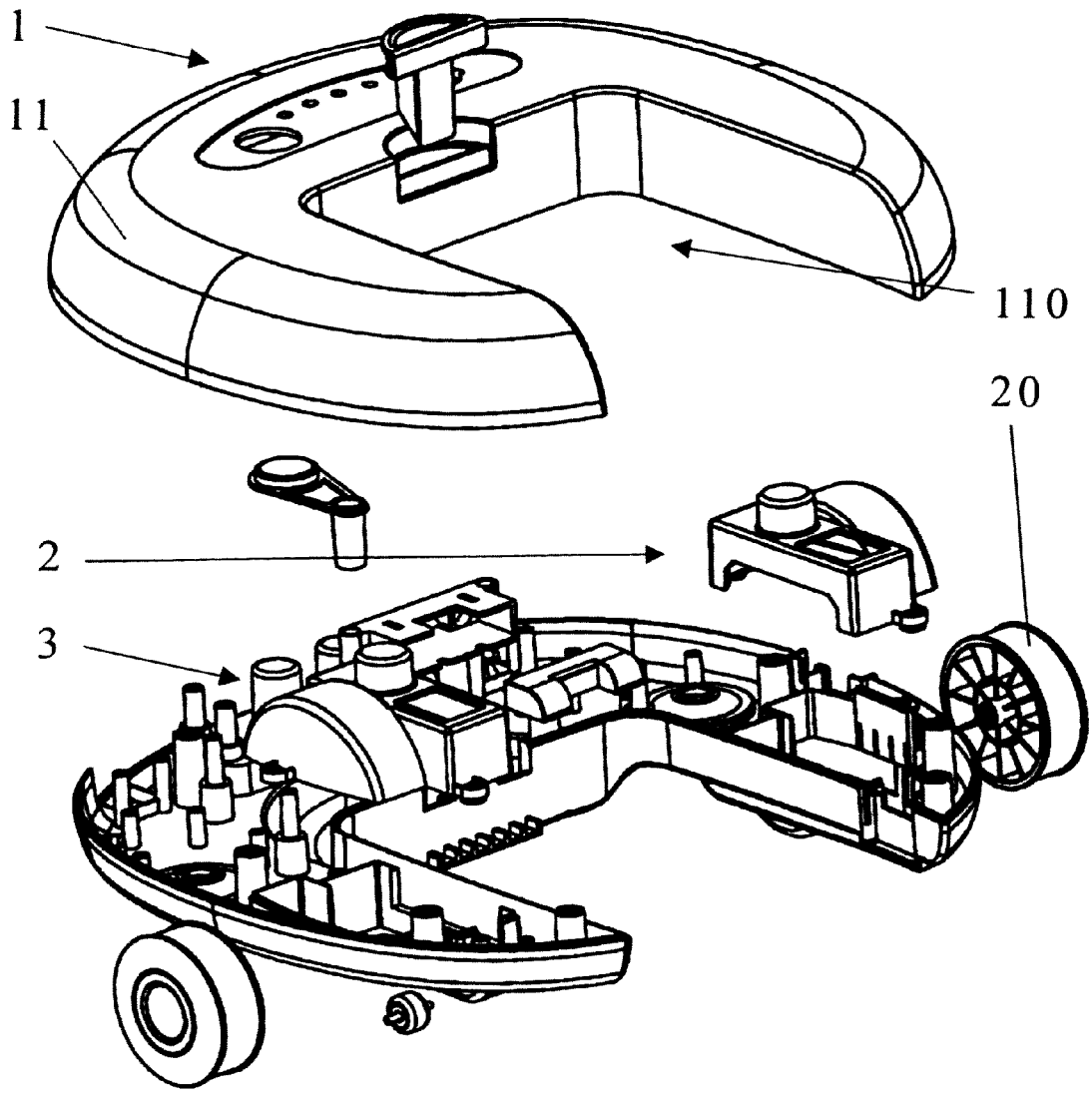
FIG. 1 is an exploded view of a part of a robotic floor cleaner according to the present invention, showing the structure of the main body and the relative positioning of the propelling unit and the control unit.
Figure 2:
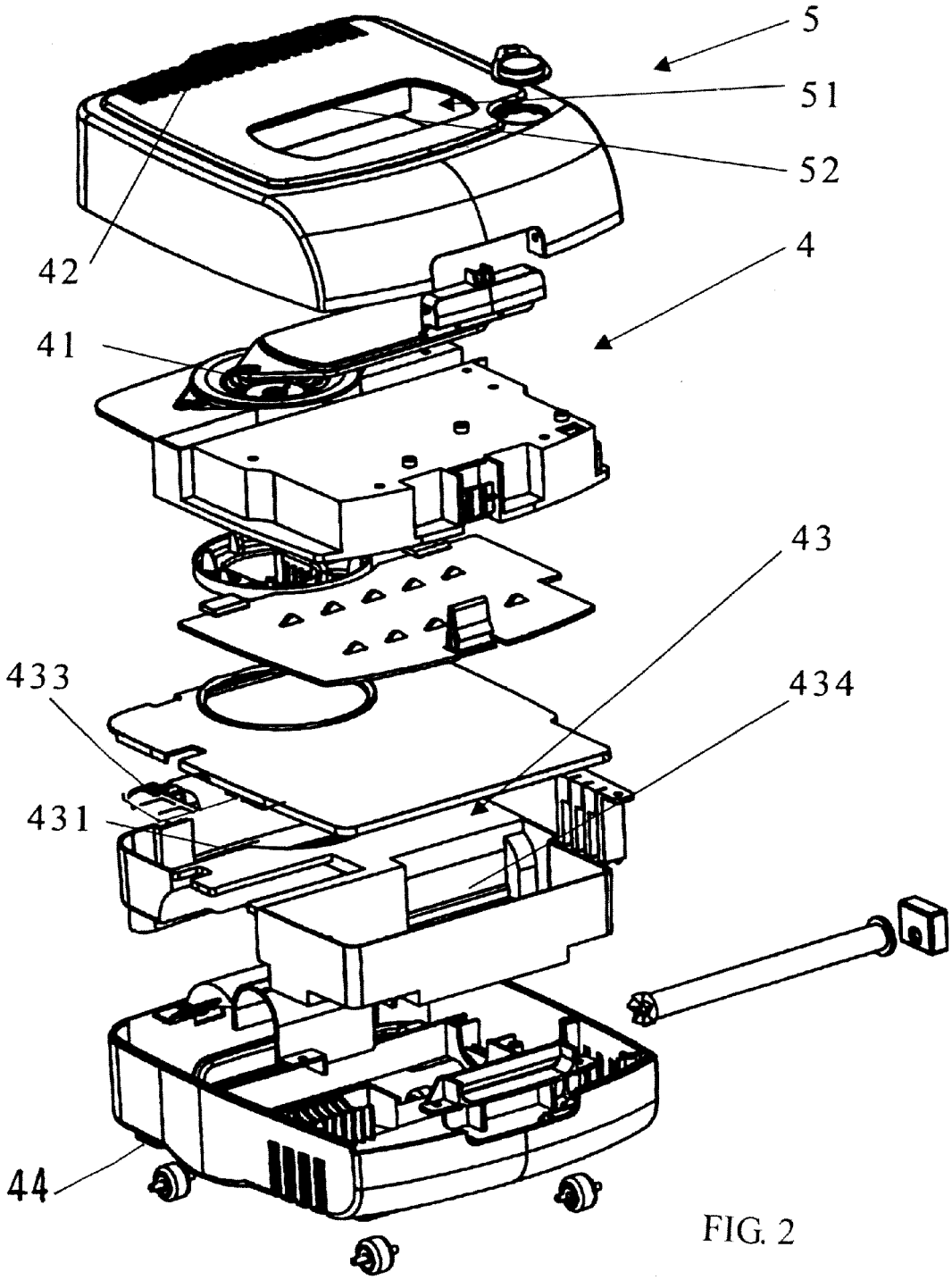
FIG. 2 is an exploded view of a part of the robotic floor cleaner according to the present invention, showing the structure of the daughter body and the vacuum cleaner unit.

Referring to FIGS. 1 and 2, a robotic floor cleaner in accordance with the present invention is shown comprised of a main body 1, a daughter body 5, and a handle assembly 6. The main body 1 houses a propelling unit 2 and a control unit 3. The daughter body 5 houses a vacuum cleaner unit 4 for removing dust, waste paper chips, sands, hairs, etc. from the floor.

The main body 1 comprises a substantially U-shaped shell 11 defining an open space 110.

The propelling unit 2 comprises two steering wheels 20 symmetrically pivotally mounted in the main body 1 at two sides for moving the main body 1 on the floor. The control unit 3 is a circuit board fixedly mounted inside the main body 1 for controlling the operation of the propelling unit 2 to move the main body 1 on the floor according to a predetermined steering mode.

Referring to FIG. 2 again, the daughter body 5 is fastened to the main body 1 and suspended in the open space 11. The vacuum cleaner unit 4 is mounted inside the daughter body 5, comprising a fan 41, an upper wind tunnel 42 disposed in front of the fan 41, a dust collector 43, and a lower wind tunnel 44 extending through the bottom side of the main body 1. The dust collector 43 comprises a collector body 431, a wire gauze filter 433 detachably covered on the top open side of the collector body 431, a battery chamber 434 disposed at the rear side of the collector body 431 and holding a set of battery cells (not shown) to provide the robotic floor cleaner with the necessary working voltage. The daughter body 5 has a top coupling hole 51 and two locating flanges 52 at two sides of the top coupling hole 51.

Figure 3:
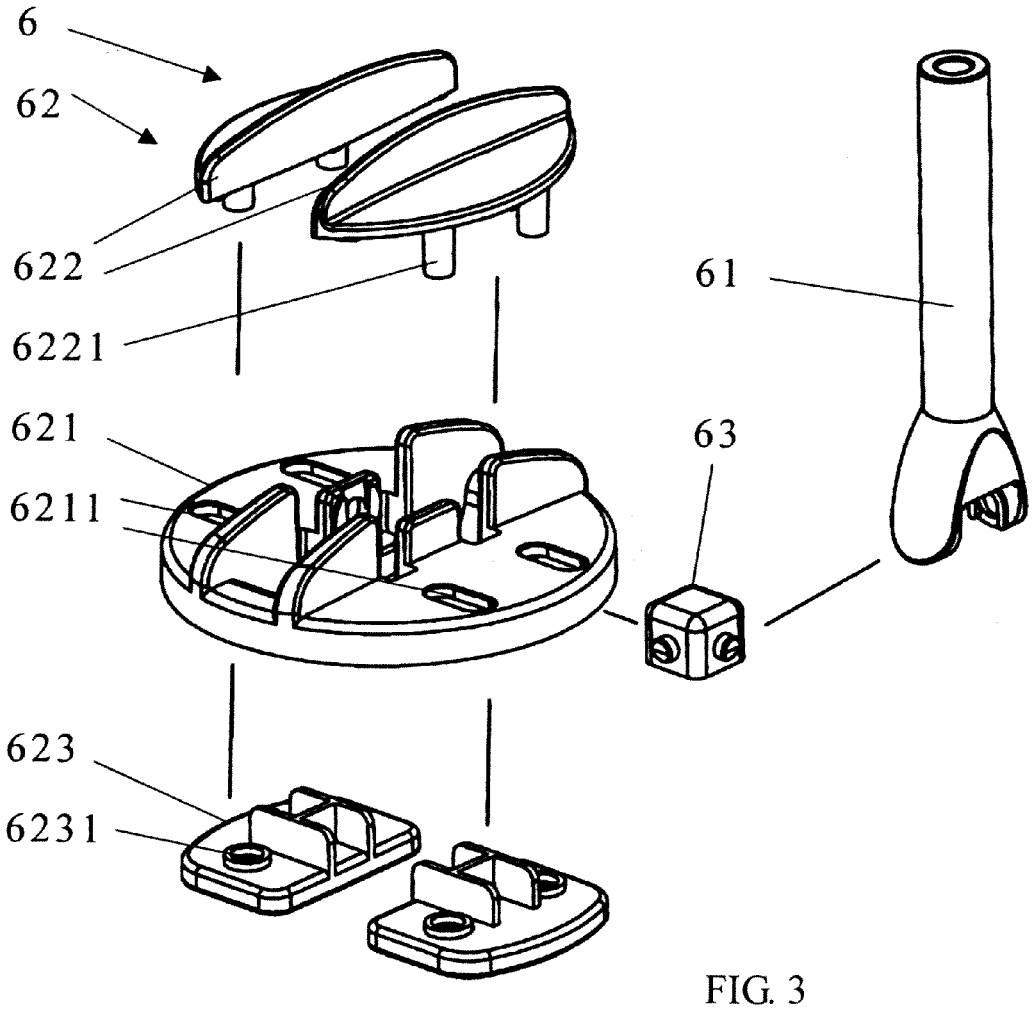
FIG. 3 is an exploded view of a part of the robotic floor cleaner according to the present invention, showing the structure of the handle assembly.
Figure 4:
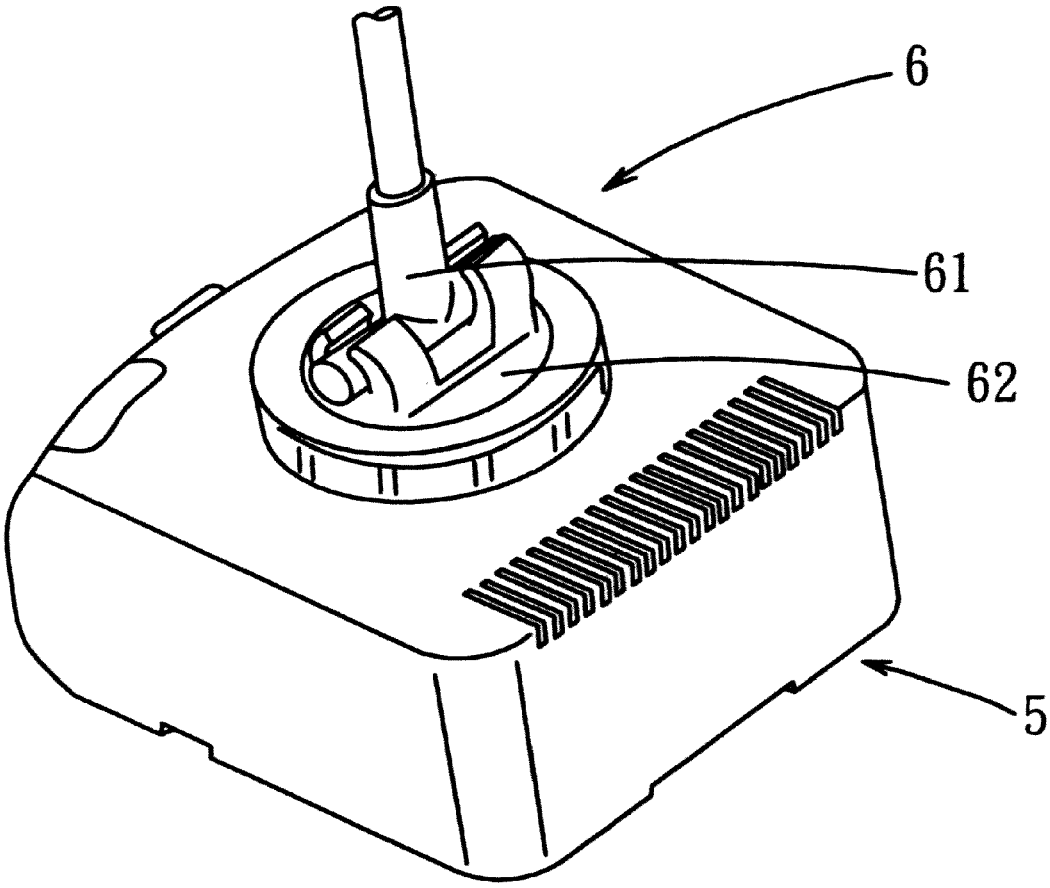
FIG. 4 is a perspective view showing the daughter body and the handle assembly assembled.

Referring to FIGS. 3 and 4, the handle assembly 6 comprises an operating rod 61, a locking mechanism 62, and a connector 63. The locking mechanism 62 comprises a base 621, which has a plurality of transversely extending elongated through holes 6211, two actuating members 622, which are bilaterally supported on the base 621 and transversely movable relative to each other and have the respective bottom rods 6221 respectively downwardly inserted through the elongated through holes 6211 of the base 621, and two locking members 623, which are respectively suspended below the base member 621 and have the respective mounting holes 6231 respectively fastened to the bottom rods 6221 of the actuating members 622. The operating rod 61 is pivotally coupled to the connector 63 at the stop side of the base 621 of the locking mechanism 62 between the actuating members 622. The user can operate the operating rod 61 to move the actuating members 62 between two positions, namely, the locking position where the locking members 623 are moved apart and respectively forced into engagement with the two locating flanges 52 of the daughter body 5 to lock the handle assembly 6 to the daughter body 5, and the unlocking position where the locking members 623 are moved toward each other and disengaged from the locating flanges 52 of the daughter body 5 to unlock the handle assembly 6 from the daughter body 5. Preferably, spring means is provided to support the actuating members 622 and the locking members 623 in the locking position.

After installation of the daughter body 5 in the main body 1, the propelling unit 2 and the control unit 3 control the steering of the robotic floor cleaner on the floor and the vacuum cleaner unit 4 automatically removes dust from the floor during movement of the robotic floor cleaner. Further, after removal of the daughter body 5 from the main body 1, the user can fasten the handle assembly 6 to the daughter body 5, enabling the vacuum cleaner unit 4 and the daughter body 5 to be used with the handle assembly 6 as an independent manual vacuum cleaner.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A robotic floor cleaner comprising:

a main body, said main body comprising a propelling unit for moving the robotic floor cleaner on the floor, and a control unit for controlling the operation of said propelling unit to move the robotic floor cleaner on the floor according to a predetermined steering mode;

a daughter body detachably fastened to said main body, said daughter body comprising a wind tunnel extending to a bottom side thereof, a dust collector, and a fan adapted to cause a vacuum in said wind tunnel to suck dust from the floor to said dust collector; and a handle assembly connectable to said daughter body, the handle assembly comprising a base, two actuating members bilaterally supported on said base and transversely movable relative to each other, and two locking members respectively fastened to said actuating members and movable with said actuating members between a locking position where said locking members are engaged with a part of said daughter body to lock said handle assembly to said daughter body and an unlocking position where said locking members are disengaged from said daughter body for allowing separation of said handle assembly from said daughter body.

* * * * *